US009789502B2

(12) United States Patent
Maddy

(10) Patent No.: US 9,789,502 B2
(45) Date of Patent: Oct. 17, 2017

(54) APPARATUS FOR DISPENSING FLUIDS USING A REMOVABLE BOTTLE

(75) Inventor: Tim Maddy, Dallas, TX (US)

(73) Assignee: Mary Kay Inc., Addison, TX (US)

( * ) Notice: Subject to any disclaimer, the term of this patent is extended or adjusted under 35 U.S.C. 154(b) by 882 days.

(21) Appl. No.: 12/479,101

(22) Filed: Jun. 5, 2009

(65) Prior Publication Data

US 2009/0302062 A1 Dec. 10, 2009

Related U.S. Application Data

(60) Provisional application No. 61/007,533, filed on Jun. 5, 2008, provisional application No. 61/095,177, filed on Sep. 8, 2008.

(51) Int. Cl.
*B67D 7/08* (2010.01)
*B05B 11/00* (2006.01)
*B05B 15/00* (2006.01)

(52) U.S. Cl.
CPC ..... *B05B 11/0054* (2013.01); *B05B 11/3059* (2013.01); *B05B 15/005* (2013.01); *A45D 2200/057* (2013.01)

(58) Field of Classification Search
CPC ..... B05B 15/005; B05B 11/3059; B05B 11/0054; A45D 2200/057
USPC ..... 222/153.09, 153.1–153.14, 183
See application file for complete search history.

(56) References Cited

U.S. PATENT DOCUMENTS

| | | | | |
|---|---|---|---|---|
| D196,393 S | | 9/1963 | Sanders, Jr. et al. | D9/448 |
| 3,254,803 A | | 6/1966 | Meshberg | 222/182 |
| 3,276,641 A | | 10/1966 | Lehmann | 222/526 |
| 3,325,054 A | | 6/1967 | Braun | 222/39 |
| 3,422,996 A | | 1/1969 | Lipman | 222/402.11 |
| 3,471,065 A | * | 10/1969 | Malone | 222/321.1 |
| 3,474,939 A | | 10/1969 | O'Donnell et al. | 222/320 |
| 3,484,023 A | | 12/1969 | Meshberg | 222/402.11 |
| 3,591,128 A | | 7/1971 | Ramis | 251/100 |
| 3,598,290 A | | 8/1971 | Steiman | 222/94 |
| 3,603,454 A | | 9/1971 | Raaf | 206/205 |
| 3,613,960 A | | 10/1971 | Beard | 222/330 |
| 3,622,052 A | | 11/1971 | Gach | 222/402.11 |
| 3,658,215 A | | 4/1972 | Ewald | 222/402.18 |
| 3,705,668 A | | 12/1972 | Schwartzman | 222/207 |
| 3,707,875 A | | 1/1973 | Freeman | 335/63 |

(Continued)

FOREIGN PATENT DOCUMENTS

| | | |
|---|---|---|
| EP | 1 317 964 | 6/2003 |
| EP | 1 389 491 | 2/2004 |

(Continued)

OTHER PUBLICATIONS

"Aerosols for apprentices; cosmetics manufacturing," *Cosmetics and Toiletries*, 111:35, 1996.

(Continued)

*Primary Examiner* — Jason Boeckmann

(74) *Attorney, Agent, or Firm* — Norton Rose Fulbright US LLP

(57) ABSTRACT

Apparatuses suited for use with, for example, fluid cosmetic products. In some embodiments, the present apparatuses include an outer sleeve, a dispenser mechanism, and an inner container. In these embodiments, the dispenser mechanism is coupled to the outer sleeve and the inner container is removably coupled to the outer sleeve.

17 Claims, 6 Drawing Sheets

(56) References Cited

U.S. PATENT DOCUMENTS

| | | | | |
|---|---|---|---|---|
| 3,722,750 | A | | 3/1973 | Fox, Jr. ..... 222/94 |
| 3,724,723 | A | | 4/1973 | Slavinski ..... 222/110 |
| 3,729,119 | A | | 4/1973 | Sette et al. ..... 222/153.11 |
| 3,797,705 | A | | 3/1974 | Cooprider ..... 222/153.13 |
| 3,848,778 | A | | 11/1974 | Meshberg ..... 222/402.11 |
| 3,851,799 | A | | 12/1974 | Paoletti ..... 222/129 |
| 3,869,070 | A | | 3/1975 | Schmoegner ..... 222/635 |
| 3,894,665 | A | | 7/1975 | Swenson ..... 222/402.11 |
| 3,933,283 | A | | 1/1976 | Hoagland ..... 222/402.13 |
| 3,973,701 | A | | 8/1976 | Gardner ..... 222/190 |
| 4,010,874 | A | | 3/1977 | Steiman ..... 222/321.3 |
| 4,057,176 | A | | 11/1977 | Horvath ..... 222/175 |
| 4,065,036 | A | | 12/1977 | Kirk, Jr. ..... 222/153.13 |
| 4,071,172 | A | | 1/1978 | Balogh ..... 222/321.7 |
| 4,087,025 | A | | 5/1978 | Steiman ..... 222/321.9 |
| 4,122,979 | A | | 10/1978 | Laauwe ..... 222/633 |
| 4,142,652 | A | | 3/1979 | Platt ..... 222/402.2 |
| 4,147,306 | A | | 4/1979 | Bennett ..... 239/327 |
| 4,155,489 | A | | 5/1979 | Steiman ..... 222/321.9 |
| 4,156,505 | A | | 5/1979 | Bennett ..... 239/327 |
| 4,162,746 | A | | 7/1979 | Anderson et al. ..... 222/153.13 |
| 4,173,297 | A | | 11/1979 | Pettersen ..... 222/321.2 |
| 4,183,615 | A | | 1/1980 | Rush ..... 385/72 |
| 4,193,514 | A | | 3/1980 | Langstroth ..... 222/4 |
| 4,203,552 | A | | 5/1980 | Hayes ..... 239/337 |
| 4,212,332 | A | | 7/1980 | Kutik et al. ..... 141/98 |
| 4,223,842 | A | | 9/1980 | Hayes ..... 239/327 |
| 4,226,367 | A | | 10/1980 | Hayes ..... 239/327 |
| 4,265,373 | A | | 5/1981 | Stoody ..... 222/94 |
| 4,265,375 | A | | 5/1981 | Flider ..... 222/189.01 |
| 4,274,560 | A | | 6/1981 | Cater ..... 222/321.2 |
| 4,278,189 | A | | 7/1981 | Kirk, Jr. ..... 222/321.2 |
| D260,605 | S | | 9/1981 | Saunders ..... D9/686 |
| 4,286,636 | A | | 9/1981 | Credle ..... 141/114 |
| 4,294,293 | A | | 10/1981 | Lorenz et al. ..... 141/100 |
| 4,311,255 | A | | 1/1982 | Meshberg ..... 222/183 |
| 4,324,351 | A | | 4/1982 | Meshberg ..... 222/402.11 |
| 4,327,782 | A | | 5/1982 | McKibben et al. ..... 141/26 |
| D265,459 | S | | 7/1982 | Picot ..... D9/686 |
| 4,343,417 | A | | 8/1982 | Corsette ..... 222/153.13 |
| 4,354,621 | A | | 10/1982 | Knickerbocker ..... 222/47 |
| 4,370,989 | A | | 2/1983 | Taylor ..... 132/317 |
| 4,398,654 | A | | 8/1983 | Pong et al. ..... 222/402.1 |
| 4,401,270 | A | | 8/1983 | McKinney ..... 239/327 |
| D270,863 | S | | 10/1983 | Martinez ..... D28/91.1 |
| D270,864 | S | | 10/1983 | Martinez ..... D28/91.1 |
| D270,956 | S | | 10/1983 | Martinez ..... D28/91.1 |
| 4,410,107 | A | | 10/1983 | Corsette ..... 222/321.7 |
| D271,243 | S | | 11/1983 | Martinez ..... D28/91.1 |
| D271,244 | S | | 11/1983 | Martinez ..... D28/91.1 |
| D271,245 | S | | 11/1983 | Martinez ..... D28/91.1 |
| 4,418,846 | A | | 12/1983 | Pong et al. ..... 222/189.1 |
| 4,420,098 | A | | 12/1983 | Bennett ..... 222/190 |
| D272,045 | S | | 1/1984 | Parr ..... D9/690 |
| 4,433,799 | A | | 2/1984 | Corsette ..... 222/309 |
| 4,434,914 | A | | 3/1984 | Meshberg ..... 222/153.11 |
| 4,435,135 | A | | 3/1984 | Knickerbocker ..... 417/511 |
| 4,437,588 | A | | 3/1984 | Shay ..... 222/321.2 |
| 4,445,539 | A | | 5/1984 | Credle ..... 137/614.03 |
| 4,454,966 | A | | 6/1984 | Hicks ..... 222/153.11 |
| 4,458,832 | A | | 7/1984 | Corsette ..... 222/153.13 |
| 4,475,667 | A | | 10/1984 | Ori et al. ..... 222/39 |
| D277,549 | S | | 2/1985 | Martinez ..... D9/687 |
| 4,506,808 | A | | 3/1985 | Goncalves ..... 222/182 |
| 4,511,064 | A | | 4/1985 | Ruscitti et al. ..... 222/153.06 |
| 4,513,890 | A | | 4/1985 | Goncalves ..... 222/153.06 |
| 4,513,891 | A | | 4/1985 | Hain et al. ..... 222/213 |
| 4,526,302 | A | | 7/1985 | Brunet ..... 222/321.7 |
| 4,549,674 | A | | 10/1985 | Alticosalian ..... 222/48 |
| 4,572,406 | A | | 2/1986 | Pratt et al. ..... 222/39 |
| 4,572,410 | A | | 2/1986 | Brunet ..... 222/402.11 |
| 4,620,646 | A | | 11/1986 | Crapser ..... 222/153.11 |
| D288,491 | S | | 2/1987 | Speitel ..... D28/91.1 |
| 4,671,330 | A | | 6/1987 | Miles ..... 141/24 |
| 4,676,408 | A | | 6/1987 | Speitel ..... 222/183 |
| 4,678,101 | A | | 7/1987 | Nitchman et al. ..... 222/82 |
| 4,679,712 | A | | 7/1987 | Foster et al. ..... 222/384 |
| 4,680,173 | A | | 7/1987 | Burger ..... 424/47 |
| D291,972 | S | | 9/1987 | Pfeiffer ..... D9/448 |
| D292,066 | S | | 9/1987 | Rodriguez Gazulla ..... D9/687 |
| D292,265 | S | | 10/1987 | Schmidt ..... D9/687 |
| 4,730,751 | A | | 3/1988 | Mackles et al. ..... 222/211 |
| D295,834 | S | | 5/1988 | Crapser ..... D9/686 |
| 4,770,323 | A | | 9/1988 | Debard ..... 222/82 |
| 4,773,567 | A | | 9/1988 | Stoody ..... 222/153.11 |
| 4,779,773 | A | | 10/1988 | Bennett ..... 222/507 |
| D299,694 | S | | 2/1989 | Geiger ..... D9/686 |
| 4,809,878 | A | | 3/1989 | Rainey ..... 222/321.9 |
| 4,836,423 | A | | 6/1989 | Hayes et al. ..... 222/257 |
| 4,850,517 | A | | 7/1989 | Ter Stege ..... 222/402.18 |
| 4,863,071 | A | | 9/1989 | Guss et al. ..... 222/207 |
| 4,865,228 | A | | 9/1989 | Landecker ..... 222/153.13 |
| 4,878,604 | A | | 11/1989 | Barriac ..... 222/209 |
| 4,889,262 | A | * | 12/1989 | Toms ..... 222/153.13 |
| D306,554 | S | | 3/1990 | Lawson ..... D9/687 |
| D307,542 | S | | 5/1990 | De Montgailhard ..... D9/687 |
| D308,474 | S | | 6/1990 | Seager ..... D9/689 |
| 4,930,670 | A | | 6/1990 | Kuo ..... 222/321.3 |
| 4,961,727 | A | | 10/1990 | Beard ..... 604/75 |
| 4,979,638 | A | | 12/1990 | Bolduc ..... 222/1 |
| D314,688 | S | | 2/1991 | Guillerm ..... D9/448 |
| 4,998,649 | A | | 3/1991 | Thanisch ..... 222/507 |
| D316,959 | S | | 5/1991 | Battegazzore ..... D9/689 |
| 5,016,783 | A | | 5/1991 | Hayes et al. ..... 222/153.13 |
| 5,018,643 | A | | 5/1991 | Bolduc ..... 222/1 |
| D317,253 | S | | 6/1991 | Seager ..... D9/689 |
| D317,714 | S | | 6/1991 | Greubel ..... D9/687 |
| D319,967 | S | | 9/1991 | Battegazzore ..... D9/689 |
| 5,052,585 | A | | 10/1991 | Bolduc ..... 222/1 |
| 5,062,549 | A | | 11/1991 | Smith et al. ..... 222/377 |
| 5,090,601 | A | | 2/1992 | Thanisch ..... 222/507 |
| 5,097,867 | A | | 3/1992 | Frigiere et al. ..... 137/590 |
| 5,110,011 | A | | 5/1992 | Laska et al. ..... 222/82 |
| 5,120,438 | A | | 6/1992 | Nakagawa et al. ..... 210/256 |
| 5,123,571 | A | | 6/1992 | Rebeyrolle et al. ..... 222/105 |
| 5,127,553 | A | | 7/1992 | Weinstein ..... 222/158 |
| 5,143,288 | A | | 9/1992 | Kohler et al. ..... 239/1 |
| 5,180,084 | A | | 1/1993 | Favre ..... 222/192 |
| 5,183,186 | A | | 2/1993 | Delaney, Jr. ..... 222/211 |
| 5,192,006 | A | | 3/1993 | Van Brocklin et al. ... 222/321.9 |
| 5,222,633 | A | | 6/1993 | Blake ..... 222/179 |
| 5,244,128 | A | | 9/1993 | De Laforcade ..... 222/403.13 |
| 5,253,786 | A | | 10/1993 | Schmidt ..... 222/153.03 |
| D341,225 | S | | 11/1993 | Lang et al. ..... D28/76 |
| D344,231 | S | | 2/1994 | Gagnon ..... D9/686 |
| 5,301,846 | A | | 4/1994 | Schmitz ..... 222/211 |
| 5,301,852 | A | | 4/1994 | Mancini ..... 222/321.9 |
| 5,310,093 | A | | 5/1994 | Bennett ..... 222/190 |
| 5,314,093 | A | | 5/1994 | Gross et al. ..... 222/153.14 |
| 5,318,205 | A | | 6/1994 | Delaney, Jr. ..... 222/211 |
| 5,323,933 | A | | 6/1994 | Brakarz et al. ..... 222/321.2 |
| 5,328,055 | A | | 7/1994 | Battle ..... 222/83.5 |
| 5,335,821 | A | | 8/1994 | Osgar ..... 222/83 |
| 5,348,194 | A | | 9/1994 | Mascitelli et al. ..... 222/209 |
| 5,351,862 | A | * | 10/1994 | Weag ..... 222/145.3 |
| 5,358,037 | A | | 10/1994 | Edwards et al. ..... 166/105 |
| 5,366,118 | A | | 11/1994 | Ciammitti et al. ..... 222/153.1 |
| 5,379,924 | A | | 1/1995 | Taylor ..... 222/402.11 |
| 5,388,730 | A | | 2/1995 | Abbott et al. ..... 222/153.13 |
| 5,399,040 | A | | 3/1995 | Holloway ..... 401/78 |
| 5,409,136 | A | | 4/1995 | Workum ..... 222/1 |
| 5,435,460 | A | | 7/1995 | Osgar ..... 222/1 |
| 5,443,596 | A | | 8/1995 | Junino et al. ..... 8/412 |
| 5,460,207 | A | | 10/1995 | Meshberg ..... 141/1 |
| 5,464,129 | A | | 11/1995 | Ho ..... 222/377 |
| D365,990 | S | | 1/1996 | McSwiggan et al. ..... D9/448 |
| 5,503,302 | A | | 4/1996 | DeJonge ..... 222/82 |
| 5,503,303 | A | | 4/1996 | LaWare et al. ..... 222/153.12 |
| 5,509,578 | A | * | 4/1996 | Livingstone ..... 222/82 |
| 5,522,548 | A | | 6/1996 | Gallien et al. ..... 239/337 |
| 5,526,960 | A | | 6/1996 | Breidenbach et al. ..... 222/183 |
| 5,531,359 | A | | 7/1996 | Winner ..... 222/153.11 |
| D375,263 | S | | 11/1996 | Knickerbocker ..... D9/448 |
| 5,573,143 | A | | 11/1996 | Deardurff et al. ..... 222/153.14 |

(56) References Cited

U.S. PATENT DOCUMENTS

| | | | | |
|---|---|---|---|---|
| 5,586,694 | A | 12/1996 | Breidenbach et al. | 222/183 |
| 5,590,815 | A | 1/1997 | Montaner et al. | 222/183 |
| 5,593,064 | A | 1/1997 | Mesberg | 222/39 |
| 5,595,326 | A | 1/1997 | Bougamont et al. | 222/321.7 |
| 5,620,113 | A | 4/1997 | Meshberg | 222/1 |
| D381,261 | S | 7/1997 | Crawford | D9/686 |
| 5,649,645 | A | 7/1997 | Demarest et al. | 222/453.07 |
| 5,649,649 | A | 7/1997 | Marelli | 222/321.2 |
| 5,649,777 | A | 7/1997 | Holloway | 401/78 |
| 5,657,909 | A | 8/1997 | Barriac | 222/382 |
| 5,657,910 | A | 8/1997 | Keyser | 222/382 |
| 5,664,700 | A | 9/1997 | Battle | 222/105 |
| D388,320 | S | 12/1997 | Lamb | D9/688 |
| 5,725,128 | A | 3/1998 | Foster | 222/153.13 |
| 5,755,364 | A | 5/1998 | LeCoffre et al. | 222/564 |
| 5,762,322 | A | 6/1998 | Smith | 251/353 |
| 5,772,080 | A | 6/1998 | de Pous et al. | 222/321.7 |
| 5,772,083 | A | 6/1998 | Joulia | 222/396 |
| 5,788,119 | A | 8/1998 | Esclar et al. | 222/58 |
| 5,791,524 | A | 8/1998 | Demarest | 222/153.06 |
| 5,799,810 | A | 9/1998 | de Pous et al. | 215/274 |
| D399,745 | S | 10/1998 | Mascitelli | D9/448 |
| D400,784 | S | 11/1998 | Cummings et al. | D9/686 |
| D400,792 | S | 11/1998 | Mascitelli | D9/448 |
| D401,501 | S | 11/1998 | Nagayoshi | D9/688 |
| 5,832,965 | A | 11/1998 | Fasse et al. | 141/20 |
| 5,842,604 | A | 12/1998 | Stahley et al. | 222/95 |
| 5,850,947 | A | 12/1998 | Kim | 222/321.4 |
| D406,761 | S | 3/1999 | Garcia | D9/434 |
| 5,875,932 | A | 3/1999 | Meshberg | 222/153.13 |
| 5,875,933 | A | 3/1999 | Ellion et al. | 222/189.1 |
| 5,918,774 | A | 7/1999 | Lund et al. | 222/153.13 |
| 5,921,233 | A | 7/1999 | Gold et al. | 128/200.22 |
| 5,957,337 | A | 9/1999 | Bettison, Jr. | 222/153.11 |
| D414,697 | S | 10/1999 | Sayers | D9/448 |
| 5,967,377 | A | 10/1999 | Glynn | 222/158 |
| 5,971,230 | A | 10/1999 | Tanaka | 222/402.11 |
| 5,979,712 | A | 11/1999 | Montaner et al. | 222/321.4 |
| D419,433 | S | 1/2000 | Conway | D9/687 |
| 6,016,934 | A | 1/2000 | Moriguchi | 222/1 |
| D419,877 | S | 2/2000 | Sayers | D9/448 |
| 6,021,924 | A | 2/2000 | Suck et al. | 222/105 |
| 6,050,504 | A | 4/2000 | Schultz et al. | 239/327 |
| 6,053,363 | A | 4/2000 | Revenu | 222/82 |
| D425,407 | S | 5/2000 | Ackerman | D9/687 |
| 6,062,430 | A | 5/2000 | Fuchs | 222/105 |
| 6,065,647 | A | 5/2000 | Bliss, III et al. | 222/153.02 |
| D426,466 | S | 6/2000 | Nevins et al. | D9/529 |
| 6,076,708 | A | 6/2000 | Ceccarelli et al. | 222/189.1 |
| 6,085,927 | A | 7/2000 | Kusz | 220/23.87 |
| 6,119,897 | A | 9/2000 | Boileau | 222/78 |
| 6,126,042 | A | 10/2000 | Meshberg | 222/321.4 |
| 6,142,345 | A | 11/2000 | Laible | 222/189.1 |
| 6,186,369 | B1 | 2/2001 | Rosenthal | 222/321.7 |
| 6,186,372 | B1 | 2/2001 | Garcia et al. | 222/402.19 |
| 6,247,613 | B1 | 6/2001 | Meshberg | 222/1 |
| 6,264,073 | B1 | 7/2001 | Good et al. | 222/464.4 |
| 6,276,566 | B1 | 8/2001 | Zaksenberg | 222/78 |
| 6,283,335 | B1 | 9/2001 | Young et al. | 222/182 |
| 6,290,100 | B1 | 9/2001 | Yacko et al. | 222/129 |
| 6,302,302 | B1 | 10/2001 | Albisetti | 222/153.11 |
| D449,978 | S | 11/2001 | Viellard | D9/687 |
| 6,364,172 | B1 | 4/2002 | Maas et al. | 222/383.1 |
| 6,382,463 | B2 | 5/2002 | Meshberg | 222/1 |
| 6,398,133 | B1 | 6/2002 | Schultz | 239/327 |
| 6,427,870 | B2 | 8/2002 | De Laforcade | 222/1 |
| 6,435,376 | B1 | 8/2002 | Meshberg | 222/321.7 |
| D466,403 | S | 12/2002 | Haas et al. | D9/687 |
| D467,162 | S | 12/2002 | Viellard | D9/687 |
| 6,502,726 | B1 | 1/2003 | Yquel | 222/321.1 |
| 6,523,722 | B1 | 2/2003 | Clark et al. | 222/153.14 |
| D472,460 | S | 4/2003 | Garcia | D9/687 |
| D473,457 | S | 4/2003 | Reinoso | D9/686 |
| 6,561,232 | B1 | 5/2003 | Frutin | 141/9 |
| 6,601,735 | B2 | 8/2003 | Milian et al. | 222/153.11 |
| 6,612,468 | B2 | 9/2003 | Pritchett et al. | 222/190 |
| 6,622,931 | B2 | 9/2003 | Bonningue | 239/1 |
| 6,641,001 | B2 | 11/2003 | Beranger et al. | 222/321.9 |
| 6,644,511 | B2 | 11/2003 | Hsu et al. | 222/129 |
| 6,648,538 | B2 | 11/2003 | Gueret | 401/130 |
| 6,685,062 | B1 | 2/2004 | Ki | 222/321.7 |
| 6,695,171 | B2 | 2/2004 | Walters et al. | 222/153.13 |
| 6,695,179 | B2 | 2/2004 | Mandile | 222/464.3 |
| 6,708,852 | B2 | 3/2004 | Blake | 222/321.5 |
| 6,739,481 | B2 * | 5/2004 | Meshberg | 222/153.11 |
| D490,699 | S | 6/2004 | Nelson et al. | D9/689 |
| D491,456 | S | 6/2004 | Cagle | D9/687 |
| 6,742,677 | B2 | 6/2004 | Petit et al. | 222/321.7 |
| 6,758,373 | B2 | 7/2004 | Jackson et al. | 222/153.11 |
| 6,766,922 | B2 | 7/2004 | da Silva | 222/211 |
| 6,776,311 | B2 | 8/2004 | Ackerman | 222/321.7 |
| 6,779,690 | B2 | 8/2004 | Masuzzo et al. | 222/321.4 |
| 6,779,693 | B2 | 8/2004 | Sweeton et al. | 222/464.4 |
| D499,012 | S | 11/2004 | Illenberger | D9/686 |
| 6,817,488 | B2 | 11/2004 | Meshberg | 222/153.11 |
| 6,832,702 | B2 | 12/2004 | Garcia | 222/183 |
| 6,832,704 | B2 | 12/2004 | Smith | 222/402.1 |
| 6,843,368 | B1 | 1/2005 | Frutin | 206/219 |
| 6,868,990 | B2 | 3/2005 | Cater et al. | 222/190 |
| D507,753 | S | 7/2005 | Lamb et al. | D9/689 |
| 6,932,244 | B2 | 8/2005 | Meshberg | 222/153.13 |
| 6,932,248 | B2 | 8/2005 | Fracasso | 222/522 |
| 6,935,540 | B2 | 8/2005 | Ackermann | 222/321.7 |
| 6,938,802 | B2 | 9/2005 | Petit | 222/321.7 |
| 6,945,419 | B2 | 9/2005 | Bertazza et al. | 220/23.87 |
| D511,302 | S | 11/2005 | Lamb et al. | D9/689 |
| 6,971,552 | B2 | 12/2005 | Meshberg | 222/153.13 |
| 6,978,916 | B2 | 12/2005 | Smith | 222/402.2 |
| 6,983,864 | B1 | 1/2006 | Cagle | 222/131 |
| 6,986,444 | B2 | 1/2006 | Fuchs | 222/321.9 |
| 7,011,237 | B1 | 3/2006 | Sayers et al. | 222/321.9 |
| 7,147,135 | B2 | 12/2006 | Le Maner | 222/321.9 |
| 7,163,125 | B2 | 1/2007 | Murakami et al. | 222/51 |
| 7,191,920 | B2 | 3/2007 | Boll et al. | 222/333 |
| 7,207,468 | B2 | 4/2007 | Cohen et al. | 222/321.9 |
| 7,222,755 | B2 | 5/2007 | Glynn et al. | 222/205 |
| 7,249,692 | B2 | 7/2007 | Walters et al. | 222/153.11 |
| 7,261,226 | B2 | 8/2007 | Adams et al. | 222/521 |
| D551,077 | S | 9/2007 | Bloc | D9/448 |
| 7,264,724 | B2 | 9/2007 | Vigna et al. | 210/321.75 |
| 7,325,706 | B2 | 2/2008 | Sweeton et al. | 222/382 |
| 7,455,195 | B2 | 11/2008 | Mekata | 222/94 |
| 7,487,891 | B2 | 2/2009 | Yerby et al. | 222/153.13 |
| 7,503,466 | B2 | 3/2009 | Ramet | 2/321.9 |
| 2002/0082545 | A1 | 6/2002 | Sennett et al. | 604/32 |
| 2002/0148860 | A1 | 10/2002 | Cohen et al. | 222/321.7 |
| 2004/0047826 | A1 | 3/2004 | Brown | 424/70.12 |
| 2004/0230357 | A1 | 11/2004 | Kobayashi | 701/36 |
| 2005/0072813 | A1 | 4/2005 | Walton et al. | 222/464.3 |
| 2005/0133544 | A1 | 6/2005 | Tadlock et al. | 222/464.2 |
| 2005/0184090 | A1 | 8/2005 | DeJonge | 222/129 |
| 2005/0189382 | A1 | 9/2005 | Laidler et al. | 222/402.19 |
| 2005/0242123 | A1 | 11/2005 | Finlay et al. | 222/189.1 |
| 2005/0284891 | A1 | 12/2005 | Ramet et al. | 222/321.7 |
| 2006/0043109 | A1 | 3/2006 | Masuda | 222/105 |
| 2006/0237489 | A1 | 10/2006 | De Lataulade | 222/464.1 |
| 2006/0278661 | A1 | 12/2006 | Cooper et al. | 222/321.1 |
| 2007/0020032 | A1 | 1/2007 | Abbas | 401/188 A |
| 2008/0116223 | A1 * | 5/2008 | Stradella | 222/162 |
| 2009/0057331 | A1 * | 3/2009 | Fryan et al. | 221/96 |

FOREIGN PATENT DOCUMENTS

| | | |
|---|---|---|
| GB | 2 391 862 | 2/2009 |
| JP | 2004-067237 | 3/2004 |

OTHER PUBLICATIONS

"Compact pump; new products material," *Packaging Digest*, 42:60, 2005.

"Discreet tube; WRAP up; the latest in packaging innovation," *Global Cosmetic Industry*, 175:20, 2007.

(56) References Cited

OTHER PUBLICATIONS

"Extraction diptubes; new products; equipment," *Packaging Digest*, 43:69, 2006.

* cited by examiner

APPARATUS FOR DISPENSING FLUIDS USING A REMOVABLE BOTTLE

RELATED APPLICATIONS

This application claims priority to U.S. Provisional Application No. 61/007,533, filed on Jun. 5, 2008, and U.S. Provisional Application No. 61/095,177, filed on Sep. 8, 2008, both of which are incorporated herein in their entireties.

BACKGROUND

1. Field

The present invention relates generally to systems for holding and delivering fluids, and more particularly to systems for the holding and non-aerosol dispensing of fluid cosmetic products.

2. Description of Related Art

Fluid products are typically stored within containers. For example, fluid cosmetic products are often stored in bottles and the like. A container may be used in conjunction with a dispensing unit to provide controlled dispensing of the contained fluid product.

SUMMARY

Embodiments of the present apparatuses are well suited for use with fluid products, providing a replaceable inner container that may be economically constructed of readily-recyclable materials and an outer sleeve that may be more durable and aesthetically pleasing.

Some embodiments of the present apparatuses include an outer sleeve that defines an inner area. The outer sleeve has an upper sleeve end that is open, a lower sleeve end opposite the upper sleeve end that is also open, and a sleeve body section between the upper sleeve end and the lower sleeve end.

In some embodiments, the outer sleeve also includes a spout cutout section that meets the upper sleeve end. The spout cutout section may have a shallow notch portion and a deep notch portion. The outer sleeve may also include a finger cutout section that meets the upper sleeve end and is opposite the spout cutout section. The outer sleeve may also include a viewing section through which a portion of the inner area is visible from outside of the inner area. The viewing section may allow a portion of the inner container to be visible from outside of the inner area when the inner container is coupled to the outer sleeve.

Some embodiments of the present apparatuses include a dispenser mechanism coupled to the outer sleeve, the dispenser mechanism having a spout configured for dispensing fluid cosmetic product.

In some embodiments, the spout can be rotated such that it protrudes through the shallow notch portion or through the deep notch portion. In these embodiments, the dispenser mechanism can be actuated when the spout protrudes through the deep notch portion, and the dispenser mechanism can not be actuated when the spout protrudes through the shallow notch portion. In some embodiments, the dispenser mechanism has a diptube.

Some embodiments of the present apparatuses include an inner container configured to hold fluid cosmetic product. The inner container has a container body portion and a container base portion. The container body portion has a container mouth. The inner container may be removably coupled to the outer sleeve at the lower sleeve end. In some embodiments, the inner container may be removably coupled to the outer sleeve at the lower sleeve end such that the container body portion is within the inner area and the container base portion extends past the lower sleeve end. The inner container may be removed from the outer sleeve without removal of other parts.

In some embodiments, the inner container may also include a top seal covering the container mouth. In some of these embodiments, the top seal may be punctured by a diptube that is part of the dispenser mechanism. In other embodiments, the inner container may include a diptube.

Any embodiment of any of the present apparatuses may consist of or consist essentially of—rather than comprise/include/contain/have—the described elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

Details associated with the embodiments described above and others are presented below. Other embodiments of the present apparatuses are possible.

BRIEF DESCRIPTION OF THE DRAWINGS

The following drawings illustrate by way of example and not limitation. They are drawn to scale (in terms of proportions). Identical reference numerals do not necessarily indicate an identical structure. Rather, the same reference numeral may be used to indicate a similar feature or a feature with similar functionality. Not every feature of each embodiment is labeled in every figure in which that embodiment appears, in order to keep the figures clear.

DESCRIPTION OF ILLUSTRATIVE EMBODIMENTS

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

The terms "a" and "an" are defined as one or more than one unless this disclosure explicitly requires otherwise.

Figure 1:
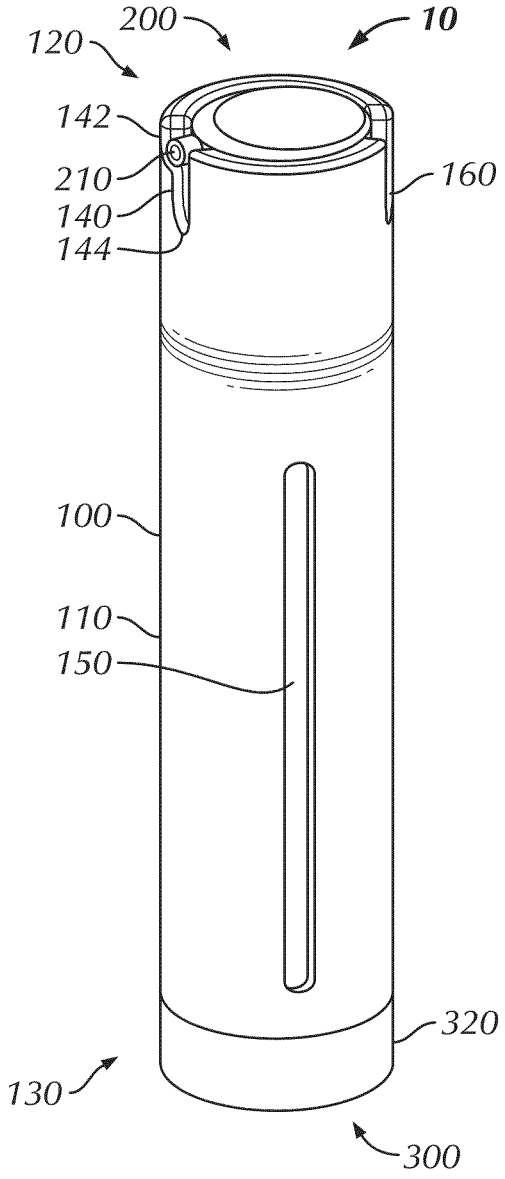
FIG. 1 is a perspective view of one of the present apparatuses that includes embodiments of the present outer sleeves, dispenser mechanisms, and inner containers.
Figure 2A:
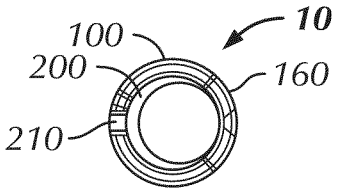
FIGS. 2A, 2B, 2C, and 2D are top, left side, front, and right side views of the apparatus shown in FIG. 1.
Figure 2B:
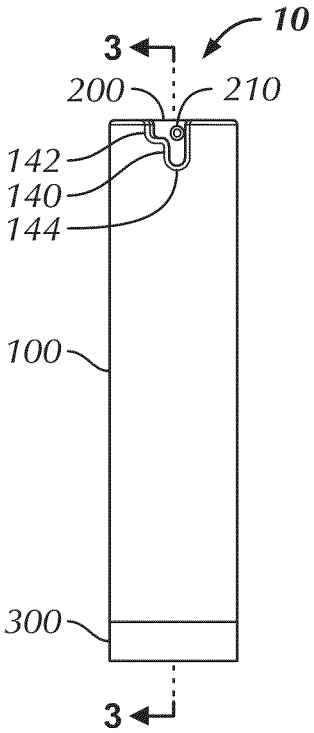
Figure 2C:
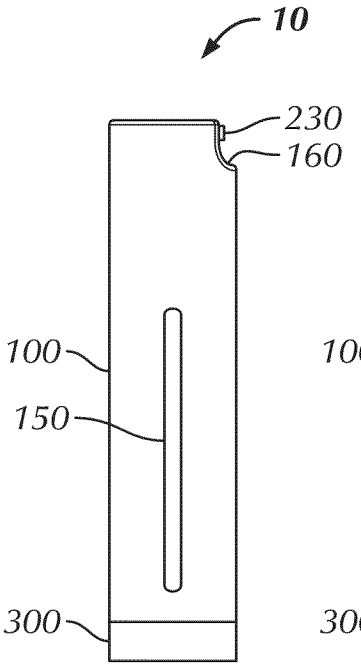
Figure 2D:
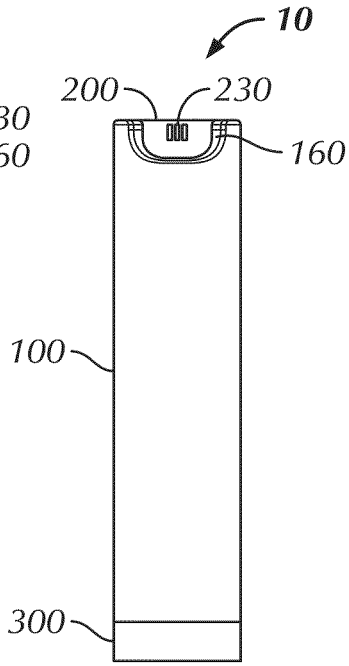

An example of the present apparatuses appears in perspective in FIG. 1. Apparatus 10 includes outer sleeve 100, dispenser mechanism 200, and inner container 300. Some embodiments of apparatus 10 may include outer sleeve 100 and dispenser mechanism 200 without inner container 300. Other embodiments may include inner container 300 without outer sleeve 100 or dispenser mechanism 200.

Embodiments of outer sleeve 100 may be of durable construction, being designed for several years of use. These embodiments may have features aimed at being cosmetically attractive, such as glossy or textured surface finishes, screen printing, or other ornamental features. Protective coatings, such as UV lacquer, may be used to increase the longevity of the ornamental features. Some embodiments of outer sleeve 100 may be constructed of metal. Other embodiments may be constructed of durable plastics that are suitable for the application of ornamental features, such as acrylonitrile butadiene styrene (ABS). Other embodiments may be fabricated from other materials, or a combination of materials.

Referring to FIGS. 2A-2D and FIGS. 3-4, outer sleeve 100 has sleeve body section 110 between upper sleeve end 120 and lower sleeve end 130. Upper sleeve end 120 and lower sleeve end 130 are both open, with inner area 190 being within sleeve body section 110 and between upper sleeve end 120 and lower sleeve end 130.

Dispenser mechanism 200 may be coupled to outer sleeve 100 at upper sleeve end 120, and may be any mechanism suitable for non-aerosol dispensing of fluid cosmetic product. For example, dispenser mechanism 200 may be a dispensing pump that dispenses fluid cosmetic product when it is actuated. The term "coupling" is defined as joining such that there is direct contact between the coupled parts.

Dispenser mechanism 200 may have spout 210, through which fluid cosmetic product may be dispensed. Some embodiments of dispenser mechanism 200 include diptube 220 to facilitate dispensing of the fluid cosmetic product. Diptube 220 may be rigid or flexible.

Some embodiments of outer sleeve 100 have spout cutout section 140 that meets upper sleeve end 120. Spout cutout section 140 may have shallow notch portion 142 and deep notch portion 144. In some embodiments of apparatus 10, dispenser mechanism 200 is coupled to outer sleeve 100 in such a way that spout 210 protrudes through spout cutout section 140 so that spout end 212 extends past inner sleeve body surface 112. In some embodiments, spout end 212 is flush with outer sleeve body surface 114. In other embodiments, spout end 212 may extend past outer sleeve body surface 114 to provide clearance from outer sleeve body surface 114 when dispensing fluid cosmetic product.

Some embodiments of apparatus 10 are configured such that dispenser spout 210 can be rotated so that spout 210 protrudes through spout cutout section 140 at either shallow notch portion 142 or deep notch portion 144. In some of these embodiments, dispenser mechanism 200 can be actuated when spout 210 protrudes through deep notch portion 144, but can not be actuated when spout 210 protrudes through shallow notch portion 142. One of ordinary skill in the art will recognize that this position-dependent restriction on the actuation of dispenser mechanism 200 may be accomplished by mechanical methods. For example, dispenser mechanism 200 may be configured such that actuation requires movement of spout 210, with spout cutout section 140 being configured such that movement of spout 210 is restrained when spout 210 protrudes through shallow notch portion 142, but spout 210 has sufficient freedom of motion to allow actuation of dispenser mechanism 200 when spout 210 protrudes through deep notch portion 144. In some embodiments, spout cutout section 140 may be configured with positions other than shallow notch portion 142 or deep notch portion 144 through which spout 210 may protrude. For example, some embodiments may be configured with additional notch portions in addition to shallow notch portion 142 and deep notch portion 144 that facilitates actuation of dispenser mechanism 200 to dispense different volumes of fluid cosmetic product than the volume that is dispensed when spout 210 protrudes through deep notch portion 144.

Some embodiments of outer sleeve 100 have finger cutout section 160 that meets upper sleeve end 120 and is opposite spout cutout section 140. Outer sleeve 100 may provide a user a convenient location to access and affect rotation of dispenser mechanism 200, thereby rotating spout 210. Dispenser mechanism 200 may include finger texture feature 230 (e.g., vertical ribs or rough texturing) in the area of dispenser mechanism 200 that aligns with finger cutout section 160 to further aid a user in rotating dispenser mechanism 200.

While embodiments of outer sleeve 100 may be designed for several years of use, inner container 300 is designed to be a disposable bottle for apparatus 10 that is replaced when empty. Therefore, embodiments of inner container 300 may be fabricated from materials that are readily recyclable, such as polyethylene. Some embodiments of inner container 300 may be fabricated by blow molding. Other embodiments may be constructed from other materials and/or by other fabrication methods.

Inner container 300 may hold fluid product 390, which may be a fluid cosmetic product. In embodiments where inner container 300 "holds" fluid product 390, some portion of fluid product 390 is within a volume defined by inner container 300. In these embodiments, fluid product 390 need not occupy the entire volume defined by inner container 300, and other materials may concurrently occupy the volume defined by inner container 300.

Inner container 300 has container body portion 310 and container base portion 320. Container mouth 312 is located on container body portion 310. Inner container 300 is configured to be removably coupled to outer sleeve 100 at lower sleeve end 130. This coupling allows removal of inner container 300 from outer sleeve 100 without the removal of other parts, and may be accomplished by using mating threads, snap fits, or other suitable mechanical methods. In the embodiment illustrated in FIG. 3, inner container 300 is removably coupled to outer sleeve 100 by using mating threads at container interface portion 322 and outer sleeve interface portion 132.

When inner container 300 is removably coupled to outer sleeve 100, inner container 300 is within inner area 190 and container base portion 320 extends past lower sleeve end 130. In some embodiments, container base portion 320 may be flush with outer sleeve body surface 114 and may have ornamental features, such as a glossy or textured surface finish. Container body portion 310 may have portions constructed with lesser wall thickness than container base portion 320 to lessen material consumption and minimize waste creation. The wall thicknesses and materials of container base portion 320 may suitable to provide sufficient transparency for a user to view the level of fluid product 390 within inner container 300.

Figure 3:
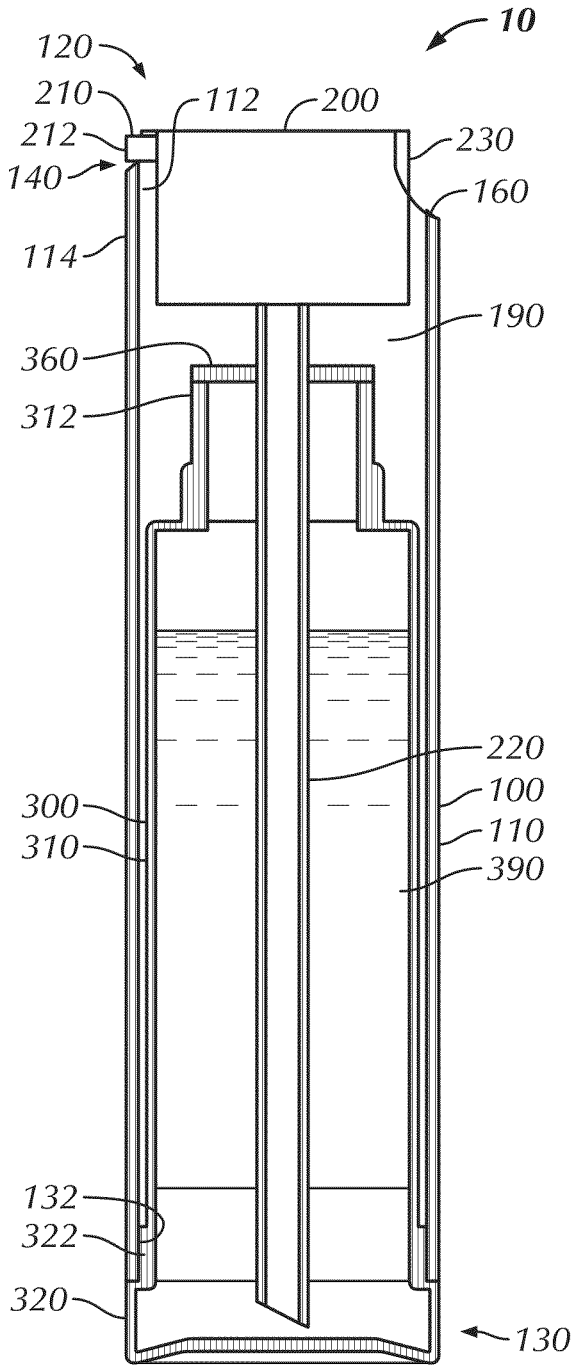
FIG. 3 is an cross-sectional view of the apparatus shown in FIG. 2A-2D taken along line 3-3.
Figure 4:
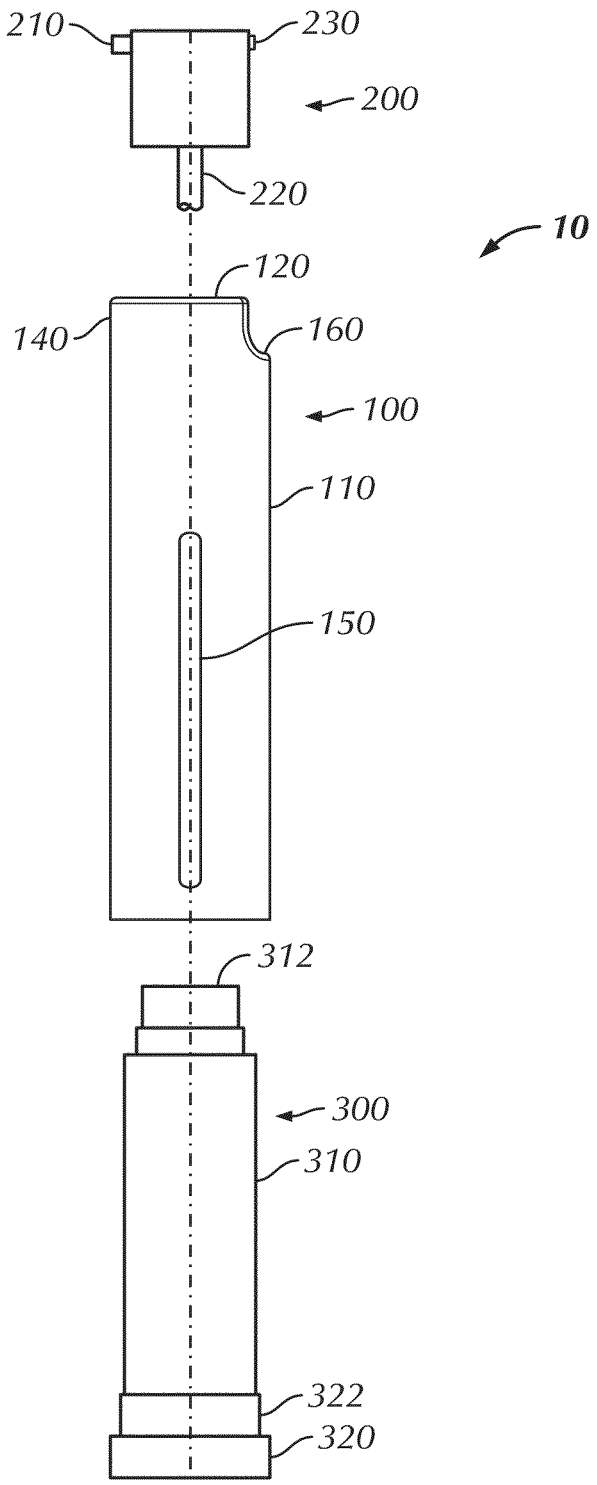
FIG. 4 is an exploded assembly view of one of the present apparatuses.

Container mouth 312 allows dispenser mechanism 200 to interface inner container 300 so that fluid product 390 may be delivered through dispenser mechanism 200. Referring to FIG. 3, this interface may be via diptube 220 that is part of dispenser mechanism 200. Top seal 360 covers container mouth 312 to facilitate containment of fluid product 390 prior to the coupling of inner container 300 to outer sleeve 100. In some embodiments, top seal 360 is induction sealed. Other embodiments may have top seal 360 that is adhesively sealed or sealed by mechanical means, such as mating threads or a snap fit. In the embodiment depicted in FIG. 3, top seal 360 is an induction seal or other seal that may be punctured, and diptube 220 is rigid. During the coupling of inner container 300 to outer sleeve 100, rigid diptube 220 punctures top seal 360. In other embodiments, top seal 360 may be removed prior to the coupling of inner container 300 to outer sleeve 100.

Figure 5:
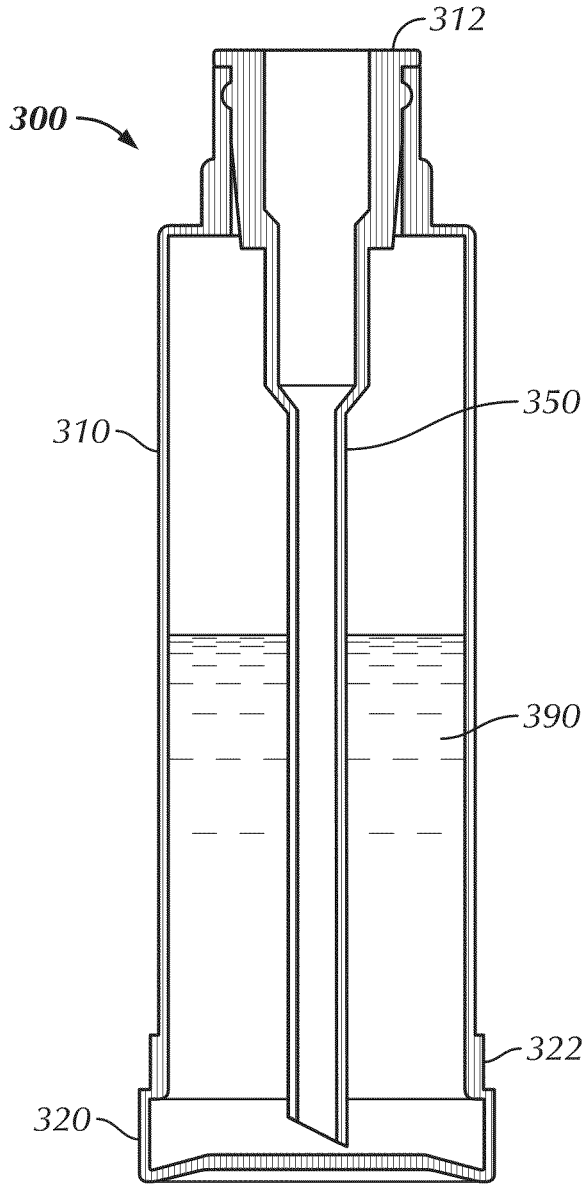
FIG. 5 is a cross-sectional view of an embodiment of the present inner containers that has an integrated diptube.

Referring to FIG. 5, other embodiments of apparatus 10 may include inner container 300 having integrated diptube 350. In these embodiments, dispenser mechanism 200 does not include diptube 220. Instead, dispenser mechanism 200 interfaces with diptube 350 of inner container 300.

Referring to FIG. 1, some embodiments of outer sleeve 100 have viewing section 150 to facilitate view of inner area 190 from outside of inner area 190. Viewing section 150 may allow a user to view the level of fluid product 390 remaining in inner container 300 when inner container 300 is coupled to outer sleeve 100. Viewing section 150 may be a region that is void of material, or it may be a region having material that is sufficiently transparent to allow view of inner area 190 (and therefore coupled inner container 300).

Figure 6:
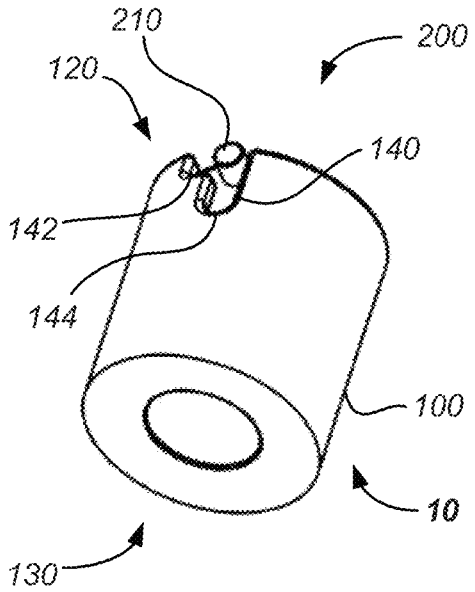
FIG. 6 is a perspective view of one of the present apparatuses that includes an embodiment of the outer sleeve that is configured to interface with a container that primarily extends past the lower sleeve end. In this embodiment, portions of the container other than the container's mouth and interface portion may not be within the inner area when the outer sleeve is coupled to the container.
Figure 7:
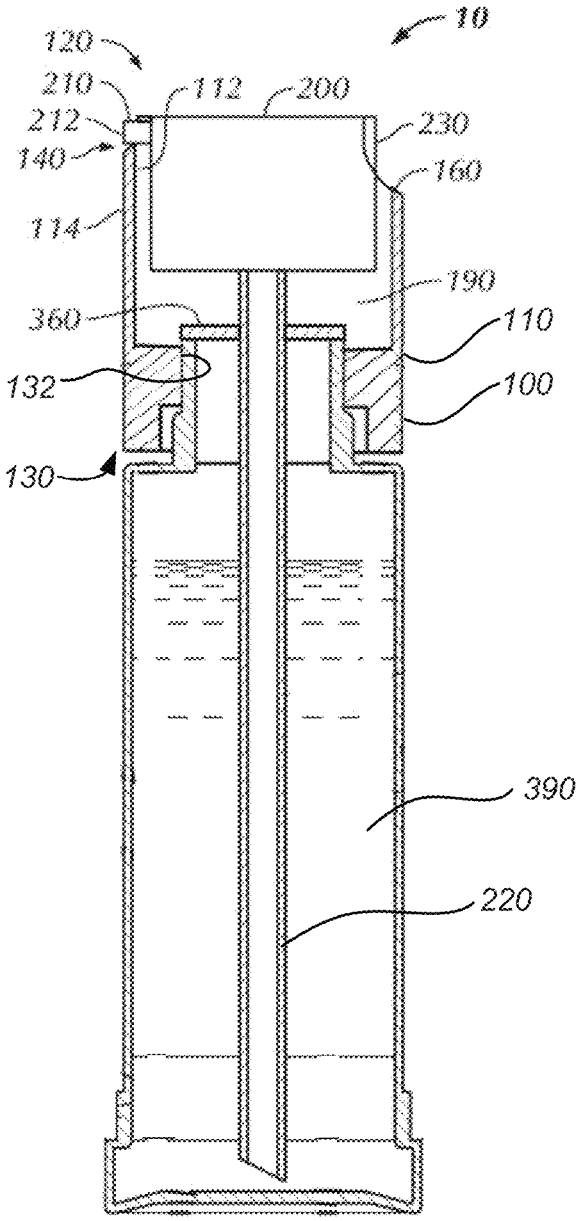
FIG. 7 is a cross-sectional view of the apparatus shown in FIG. 6 coupled to a container.

Referring to FIGS. 6 and 7, some embodiments of apparatus 10 may include outer sleeve 100 that is configured to interface with a container that primarily extends past lower sleeve end 130. In some of these embodiments, portions of the container other than the container's mouth and interface portion may not be within inner area 190 when outer sleeve 100 is coupled to the container.

Embodiments of apparatus 10 typically range in size from several inches tall to about one foot tall or more. Other embodiments may be smaller, ranging in size from less than one inch tall to several inches tall. For example, the embodiment of apparatus 10 depicted in FIGS. 6 and 7 may be about 1.5 inches tall.

It should be understood that the present apparatuses are not intended to be limited to the particular forms disclosed. Rather, they are to cover all modifications, equivalents, and alternatives falling within the scope of the claims. For example, although the present apparatuses have been described as being well suited for use with fluid cosmetic products, those of ordinary skill in the art will understand that the present apparatuses may be used with many other fluids.

Furthermore, although the components of diptube 200 of the preferred embodiment have been shown as being cylindrically shaped, the components may be of any shape. Additionally, while it is preferable that outer sleeve 100 is fabricated from metal or ABS as a unitary piece and that inner container 300 is molded in polyethylene as a unitary piece, outer sleeve 100 and/or inner container 300 may be fabricated from other materials, and may be the product of joining several discrete pieces.

The claims are not to be interpreted as including means-plus- or step-plus-function limitations, unless such a limitation is explicitly recited in a given claim using the phrase(s) "means for" or "step for," respectively.

The invention claimed is:

1. An apparatus for non-aerosol dispensing of a fluid cosmetic product comprising:

an outer sleeve that defines an inner area, the outer sleeve including:

an upper sleeve end that is open;

a lower sleeve end opposite the upper sleeve end, the lower sleeve end being open; and a sleeve body section between the upper sleeve end and the lower sleeve end;

a dispenser mechanism configured to be actuated directly by a user, the dispenser mechanism having a lateral perimeter and a length, coupled to the outer sleeve such that the outer sleeve encircles a majority of the lateral perimeter along a majority of the length of the dispenser mechanism in all operational positions of the dispenser mechanism, the dispenser mechanism having a spout extending through the outer sleeve and configured for dispensing fluid cosmetic product external to the apparatus and perpendicular to the length of the dispenser mechanism; and an inner container configured to hold fluid cosmetic product, the inner container including:

a container body portion having a container mouth; and a container base portion having an exterior transverse dimension greater than an interior transverse dimension of the outer sleeve at the lower sleeve end;

where the container body portion comprises a majority of the container;

where the container body portion occupies a majority of an interior volume of the outer sleeve; and where the inner container is removably coupled to the outer sleeve at the lower sleeve end such that the container body portion is within the inner area and the container base portion extends past the lower sleeve end to restrict movement of the outer sleeve past the container base portion;

where the apparatus is configured such that removal of the inner container from the outer sleeve does not require removal of other parts; and where the dispenser mechanism is configured to dispense fluid cosmetic product without movement of the inner container relative to the outer sleeve.

2. The apparatus of claim 1, where:

the outer sleeve further includes a spout cutout section that meets the upper sleeve end, the spout cutout section having a shallow notch portion and a deep notch portion; and the dispenser mechanism is coupled to the outer sleeve such that:

the spout can be rotated such that it protrudes through the shallow notch portion or through the deep notch portion; and the dispenser mechanism can be actuated when the spout protrudes through the deep notch portion, and the dispenser mechanism can not be actuated when the spout protrudes through the shallow notch portion.

3. The apparatus of claim 2, the outer sleeve further including a finger cutout section that meets the upper sleeve end and is opposite the spout cutout section.

4. The apparatus of claim 3, the outer sleeve further including a viewing section through which a portion of the inner container is visible from outside of the inner area when the inner container is coupled to the outer sleeve.

5. The apparatus of claim 4, the dispenser mechanism further having a diptube.

6. The apparatus of claim 5, the inner container further including a top seal covering the container mouth.

7. The apparatus of claim 6, where the top seal is punctured by the diptube.

8. The apparatus of claim 4, the inner container further including a diptube.

9. An apparatus for non-aerosol dispensing of a fluid cosmetic product comprising:

an outer sleeve that defines an inner area, the outer sleeve including:

an upper sleeve end that is open;

a lower sleeve end opposite the upper sleeve end, the lower sleeve end being open;

a sleeve body section between the upper sleeve end and the lower sleeve end;

where a maximum transverse dimension of the sleeve body section is substantially constant between the lower sleeve end and the upper sleeve end; and a dispenser mechanism configured to be actuated directly by a user, having a lateral perimeter and a length, and coupled to the outer sleeve such that the outer sleeve encircles a majority of the lateral perimeter along a majority of the length of the dispenser mechanism in all operational positions of the dispenser mechanism, the dispenser mechanism having a spout extending through the outer sleeve and configured for dispensing fluid cosmetic product external to the apparatus and perpendicular to the length of the dispenser mechanism; where:

the outer sleeve is configured to be removably coupled to an inner container at the lower sleeve end such that a majority of the inner container is within the inner area and a container base portion of the inner container extends past the lower sleeve end, the container base portion having an exterior transverse dimension greater than an interior transverse dimension of the lower sleeve end to restrict movement of the lower sleeve end past the container base portion;

the apparatus is configured such that removal of the inner container from the outer sleeve does not require removal of other parts; and where the dispenser mechanism is configured to dispense fluid cosmetic product without movement of the inner container relative to the outer sleeve.

10. The apparatus of claim 9, where:

the outer sleeve further includes a spout cutout section that meets the upper sleeve end, the spout cutout section having a shallow notch portion and a deep notch portion; and the dispenser mechanism is coupled to the outer sleeve such that:

the spout can be rotated such that it protrudes through the shallow notch portion or through the deep notch portion; and the dispenser mechanism can be actuated when the spout protrudes through the deep notch portion, and the dispenser mechanism can not be actuated when the spout protrudes through the shallow notch portion.

11. The apparatus of claim 10, the outer sleeve further including a finger cutout section that meets the upper sleeve end and is opposite the spout cutout section.

12. The apparatus of claim 11, the outer sleeve further including a viewing section through which a portion of the inner area is visible from outside of the inner area.

13. The apparatus of claim 12, the dispenser mechanism further having a diptube.

14. An apparatus for non-aerosol dispensing of a fluid cosmetic product comprising:

an outer sleeve that defines an inner area, the outer sleeve including:

an upper sleeve end that is open;

a lower sleeve end opposite the upper sleeve end, the lower sleeve end being open; and a sleeve body section between the upper sleeve end and the lower sleeve end; and a dispenser mechanism configured to be actuated directly by a user, having a lateral perimeter and a length, coupled to the outer sleeve such that the outer sleeve encircles a majority of the lateral perimeter along a majority of the length of the dispenser mechanism in all operational positions of the dispenser mechanism, a majority of the dispenser mechanism being disposed within the outer sleeve, and the dispenser mechanism having a spout extending through the outer sleeve and configured for dispensing fluid cosmetic product external to the apparatus and perpendicular to the length of the dispenser mechanism; where:

the outer sleeve is configured to be removably coupled to an inner container that includes a container base portion at the lower sleeve end the container base portion having an exterior transverse dimension greater than an inner transverse dimension of the lower sleeve end to restrict movement of the lower sleeve end past the container base portion;

the apparatus is configured such that removal of the inner container from the outer sleeve does not require removal of other parts; and where the dispenser mechanism is configured to dispense fluid cosmetic product without movement of the inner container relative to the outer sleeve.

15. The apparatus of claim 14, where:

the outer sleeve further includes a spout cutout section that meets the upper sleeve end, the spout cutout section having a shallow notch portion and a deep notch portion; and the dispenser mechanism is coupled to the outer sleeve such that:

the spout can be rotated such that it protrudes through the shallow notch portion or through the deep notch portion; and the dispenser mechanism can be actuated when the spout protrudes through the deep notch portion, and the dispenser mechanism can not be actuated when the spout protrudes through the shallow notch portion.

16. The apparatus of claim 15, the outer sleeve further including a finger cutout section that meets the upper sleeve end and is opposite the spout cutout section.

17. The apparatus of claim 16, the dispenser mechanism further having a diptube.

* * * * *